US007440129B2

(12) United States Patent
Yamade

(10) Patent No.: US 7,440,129 B2
(45) Date of Patent: Oct. 21, 2008

(54) PRINTING SYSTEM AND METHOD OF CONTROLLING A PRINTING SYSTEM

(75) Inventor: Yasushi Yamade, Yokohama (JP)

(73) Assignee: Minolta Co., Ltd., Osaka-Shi, Osaka (JP)

( * ) Notice: Subject to any disclaimer, the term of this patent is extended or adjusted under 35 U.S.C. 154(b) by 517 days.

(21) Appl. No.: 11/093,237

(22) Filed: Mar. 30, 2005

(65) Prior Publication Data

US 2005/0200881 A1 Sep. 15, 2005

Related U.S. Application Data

(62) Division of application No. 09/809,168, filed on Mar. 16, 2001, now Pat. No. 6,975,415.

(30) Foreign Application Priority Data

Mar. 17, 2000 (JP) ..... 2000-76266

(51) Int. Cl.
*G06F 3/12* (2006.01)
*G06K 15/00* (2006.01)

(52) U.S. Cl. ..... 358/1.15; 358/1.14; 358/1.13

(58) Field of Classification Search ..... 358/1.15, 358/1.13, 1.1, 1.2, 1.6, 1.9, 1.11, 1.14, 1.16, 358/1.17, 1.18, 407, 468, 437; 347/2, 3, 347/5; 399/1, 8; 715/700, 705, 708, 808, 715/840

See application file for complete search history.

(56) References Cited

U.S. PATENT DOCUMENTS 6,313,858 B1 11/2001 Kyogoku et al.
6,452,607 B1 * 9/2002 Livingston ..... 715/705

FOREIGN PATENT DOCUMENTS

| | | |
|---|---|---|
| JP | 3029019 A | 2/1991 |
| JP | 7-234767 | 9/1995 |
| JP | 9-141977 | 6/1997 |
| JP | 9-244860 | 9/1997 |
| JP | 10-138601 | 5/1998 |
| JP | 10-222445 | 8/1998 |
| JP | 10-272806 | 10/1998 |
| JP | 2000-6450 | 1/2000 |

* cited by examiner

*Primary Examiner*—Dov Popovici
(74) *Attorney, Agent, or Firm*—Buchanan Ingersoll & Rooney PC

(57) ABSTRACT

Disclosed is a printing system having a data processing apparatus on which printer driver software capable of setting various kinds of print conditions is installed, and a printer for performing a printing operation based on print job data transmitted from the data processing apparatus. The printer driver software provides a user with a setting screen on which various user-selectable setting options for printing are displayed and can visually disable at least one of the setting options from the setting screen based on information about the state of the printer acquired from the printer. The information on the state of the printer includes information on the remaining amount of a consumable item loaded in the printer or an optional device connected to the printer, information on the size of a recording medium loaded in the printer, or information as to whether the optional device is connected to the printer.

54 Claims, 10 Drawing Sheets

*Fig.4*

```
Tray1=A4Y:Full
Tray2=A4T:Near Empty
Tray3=A3T:Empty
Tray4=A4Y:Full

Option=Finisher

Duplex=Setup

Tonor=OK

StapleClip=OK

Jam=None

Error=None
```

PRINTING SYSTEM AND METHOD OF CONTROLLING A PRINTING SYSTEM

This disclosure is a divisional of application Ser. No. 09/809,168 filed Mar. 16, 2001 now U.S. Pat No. 6,975,415, the entire contents of which are herein incorporated by reference.

BACKGROUND OF THE INVENTION

The present invention relates to a printing system comprising a printer and a data processing apparatus such as a print server for transmitting job data to the printer.

In a printing system comprising a printer and a print server (for example, a personal computer) for transmitting job data such as image data or text data to the printer, a printer driver for controlling the printer is installed on the print server such that the print server can recognize a printer to which the job data is to be output. In this printing system, various kinds of conditions such as a print output time and the number of sheets to be printed are normally set on the printer driver in the print server, and then, the set information is transmitted to the printer, thereby controlling the printer. Moreover, the print server can acquire information on a printer body, for example, information on operating states (such as sheet feeding, printing and sheet discharging) and error information (such as a sheet feeding error), or information on an optional device to be connected to the printer body such as a double-sided printing unit or a finisher, for example, information on the connected state or error state of the optional device. In relation to this, in a system disclosed in, for example, Japanese Patent Application Laid-open No. 10-222445, specified information on a printer can be transmitted to a print server via bidirectional communications, wherein a change in the specified information already set can be noticed to the print server.

However, in the conventional system, the acquired information on the printer and its optional device could not be reflected in the printer driver installed on the print server. Therefore, for example, even if consumable items such as sheets, toner or staples were used up in the printer, an operator could still execute setting on consumable items on the printer driver. As a result, the printer and its optional device could not cope with the received job data, and a finish was changed or the job data was discarded.

An object of the present invention is to provide an improved printing system and method of controlling the printing system capable of solving the above-mentioned problems of the conventional system.

Another object of the present invention is to provide a printing system and method of controlling the printing system in which information on a printer body and its optional device, received from a printer is reflected in a printer driver installed on a print server, thereby enhancing efficiency of a printing operation.

SUMMARY OF THE INVENTION

In an aspect of the invention, there is provided a printing system having a data processing apparatus on which printer driver software capable of setting various kinds of print conditions is installed, and a printer for performing a printing operation based on print job data transmitted from the data processing apparatus, wherein the data processing apparatus comprises: acquiring means for acquiring information on the state of the printer; and information reflecting means for prohibiting or permitting setting of the print conditions relative to the information on the printer driver software based on the information acquired by the acquiring means.

In another aspect of the invention, there is provided a method of controlling a printing system having a data processing apparatus on which printer driver software capable of setting various kinds of print conditions is installed, and a printer for performing a printing operation based on print job data transmitted from the data processing apparatus, wherein the method comprises the steps of acquiring information on the state of the printer, and prohibiting or permitting setting of the print conditions relative to the information on the printer driver software based on the information acquired by the acquiring means.

In a further aspect of the invention, there is provided a computer programmed product for controlling a printing system having a data processing apparatus on which printer driver software capable of setting various kinds of print conditions is installed, and a printer for performing a printing operation based on print job data transmitted from the data processing apparatus, wherein the computer programmed product allows the data processing apparatus to execute the processes of acquiring information on the state of the printer and of prohibiting or permitting setting of the print conditions relative to the information on the printer driver software based on the information acquired by the acquiring means.

In a yet further aspect of the invention, there is provided a data processing apparatus to be connected with a printer, comprising: printer driver software capable of setting various kinds of print conditions; acquiring means for acquiring information on the state of the printer; and information reflecting means for prohibiting or permitting setting of the print conditions relative to the information on the printer driver software based on the information acquired by the acquiring means.

In each of the aspects of the invention, the information on the state of the printer may be information on the remaining amount of consumable item loaded in the printer or an optional device connected to the printer. Furthermore, the consumable item may be at least any one of recording mediums, printing materials and staples. Moreover, the information on the state of the printer may be information on the size of the recording medium loaded in the printer. Additionally, the information on the state of the printer may be information as to whether or not the optional device is connected to the printer.

BRIEF DESCRIPTION OF THE DRAWINGS

FIG. 4 illustrates one example of acquired information which has been converted into a file format;

DETAILED DESCRIPTION OF THE INVENTION

A preferred embodiment according to the present invention will be described below in reference to the attached drawings.

Figure 1:
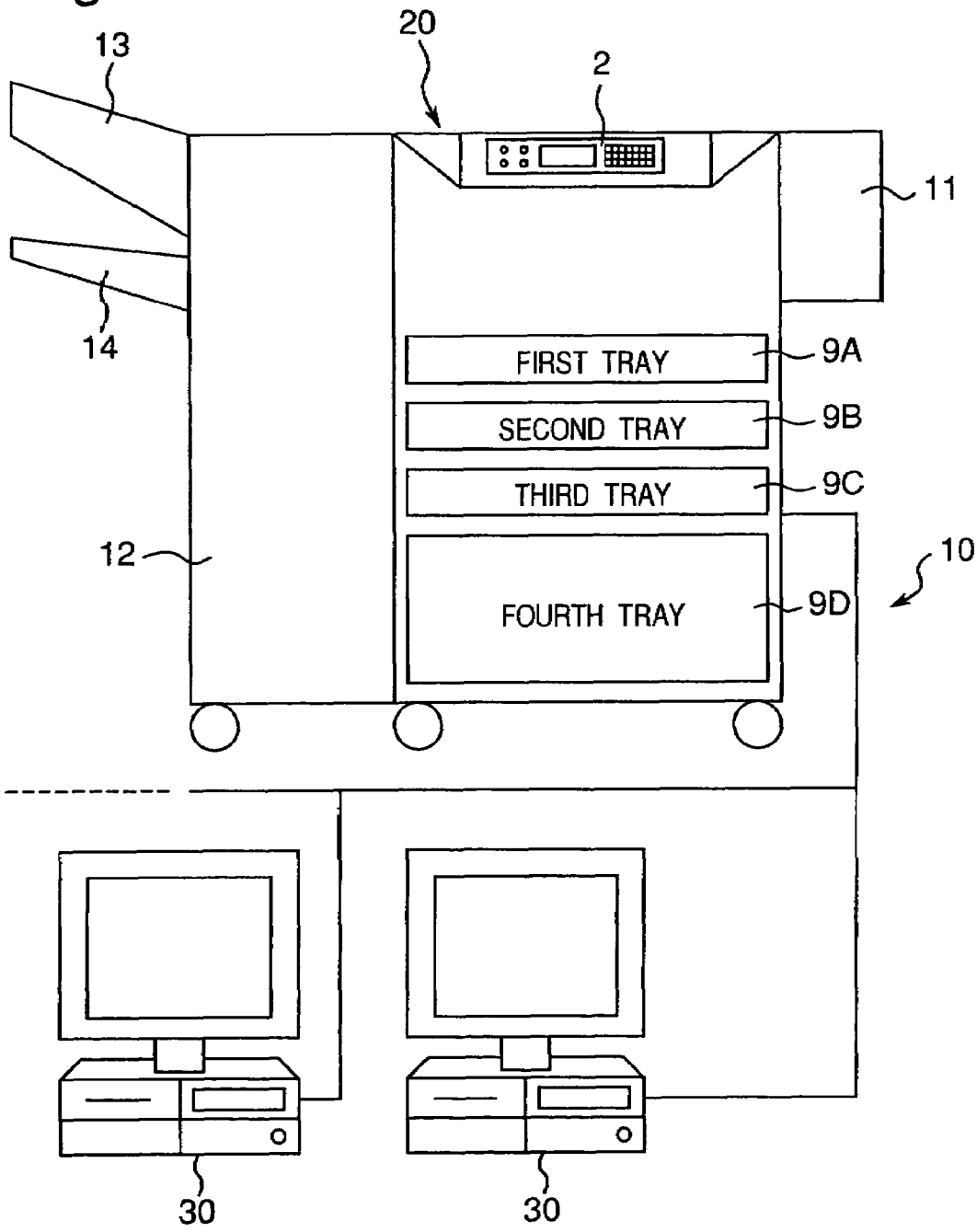
FIG. 1 is a view schematically showing a printing system in a preferred embodiment according to the present invention.

FIG. 1 is a view schematically showing a printing system in a preferred embodiment according to the present invention. The printing system 10 comprises, on a network, a printer 20 and data processing apparatus or personal computers (hereinafter abbreviated as "PCs") 30, each of which serves as a server for transmitting print job data such as image data or text data to the printer 20. On each of the PCs 30 is installed a printer driver (not shown) for controlling the printer 20 so as to recognize the printer 20 to which the job data is to be transmitted. In the above-described printing system 10, various kinds of print conditions such as the number of sheets to be printed, a printing range and the size of the sheet can be set on the printer driver installed on the PC 30. The job data is converted into data in a format suitable for the printer 20 in accordance with the set conditions, and then, is transmitted to the printer 20.

In the printer 20, the received job data is converted into print data for a raster image, which is then printed on a sheet as a recording material. The printer 20 is provided with a first tray 9A, a second tray 9B, a third tray 9C and a fourth tray 9D which contain sheets different in size or orientation. In this embodiment, a large-volume cassette is placed as the lowermost fourth tray 9D. Although not specially shown, each of the trays 9A to 9D is provided with a sensor disposed along the direction of the thickness of sheets stacked in each of the trays 9A to 9D, and thus, detects the remaining amount of sheets stacked in each of the trays in three stages of "Empty," "Nearly Empty" and "Full." Furthermore, each of the trays 9A to 9D is provided with a restricting plate for positionally restricting the sheets to be set, and consequently, the size of the sheet to be set is detected on the basis of the position of the restricting plate. Here, it is possible to arbitrarily vary the size of the sheets to be set in each of the trays 9A to 9D.

Furthermore, at the upper portion of the main body of the printer 20 is disposed a console panel 2 for setting various kinds of conditions such as printing types or printing postponement. An operator can control the operation of the printer 20 via the console panel 2.

A double-sided printing unit 11 capable of double-sided printing and a finisher 12 provided with a punch bin 13 for punching a plurality of sheets, to which images have been transferred and fixed, and a staple bin 14 for stapling a plurality of sheets as optional devices which cooperate with the main body of the printer 20 during a printing operation can be connected to the printer 20. In the preferred embodiment shown in FIG. 1, both of the optional devices 11 and 12 are connected to the printer 20.

Figure 2:
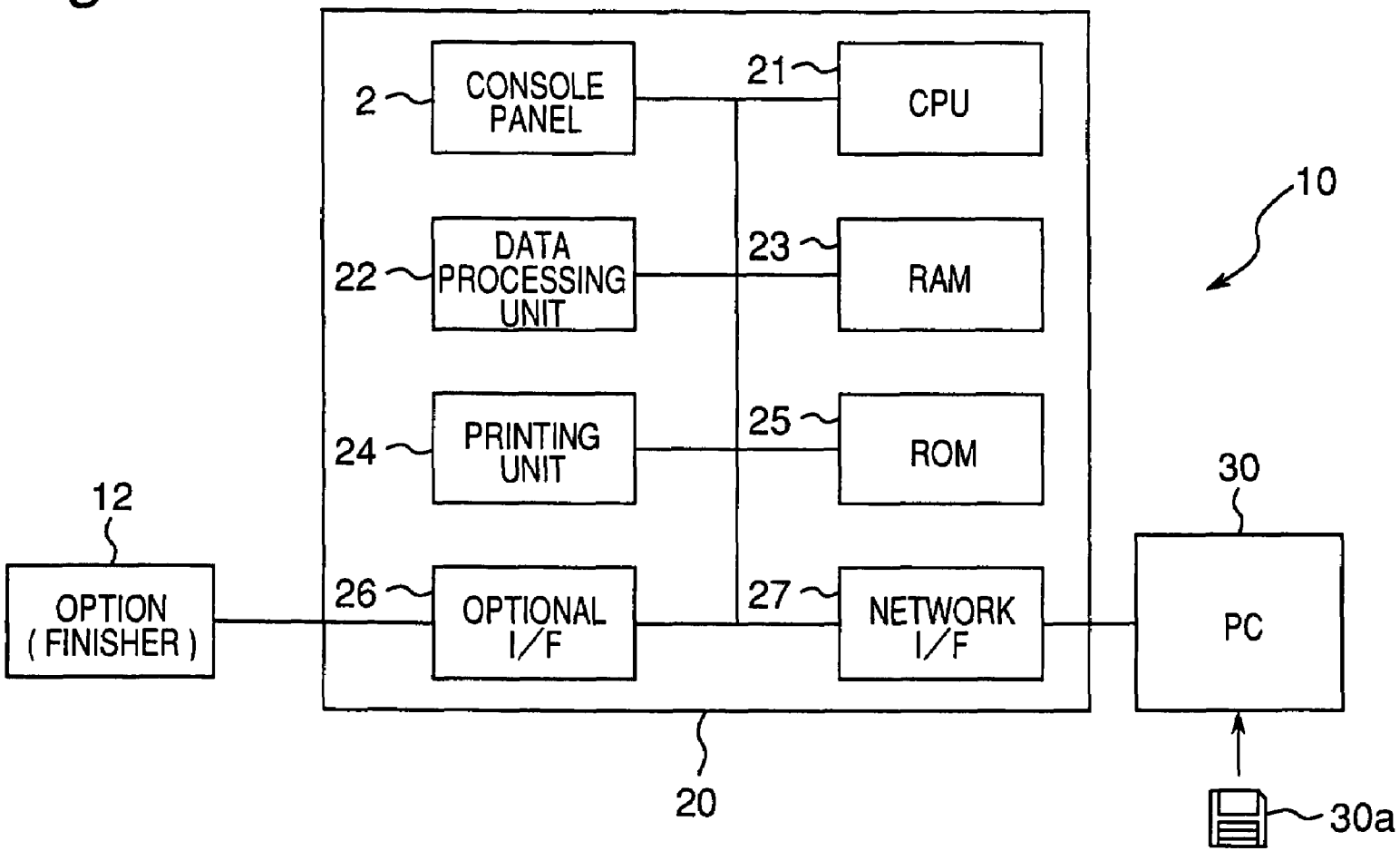
FIG. 2 is a block diagram illustrating the configuration of a printer in the printing system.

FIG. 2 is a block diagram illustrating the configuration of the printer 20 in the printing system 10. The printer 20 comprises a CPU 21 for performing the entire sequence control of the printer 20, a data processing unit 22 capable of executing data processing such as color spatial conversion or binary processing, and a printing unit 24 for subjecting the sheet to printing process based on the data processed by the data processing unit 22, with the above-described console panel 2. Moreover, the printer 20 comprises a ROM 25 for storing therein a program for use in printer control by the CPU 21 and a RAM 23 to be used as a work area required for executing the program or a buffer area for the job data. Additionally, the printer 20 comprises, as outside interfaces, an optional interface (I/F) 26 serving as an interface circuit with respect to the above-described optional devices (only the finisher 12 is shown in FIG. 2) and a network interface (I/F) 27 serving as an interface circuit with respect to the PC 30.

When the printer 20 such configured as described above receives the job data from the PC 30 via the network I/F 27, the data is printed under the control of the operations of the component parts in accordance with the printer controlling program stored in the ROM 25 in reference to the various kinds of conditions set on the console panel 2. At this time, the operations of the double-sided printing unit 11 and the finisher 12 connected as the optional devices for the printer 20 are controlled in tune with the printer 20.

Figure 3:
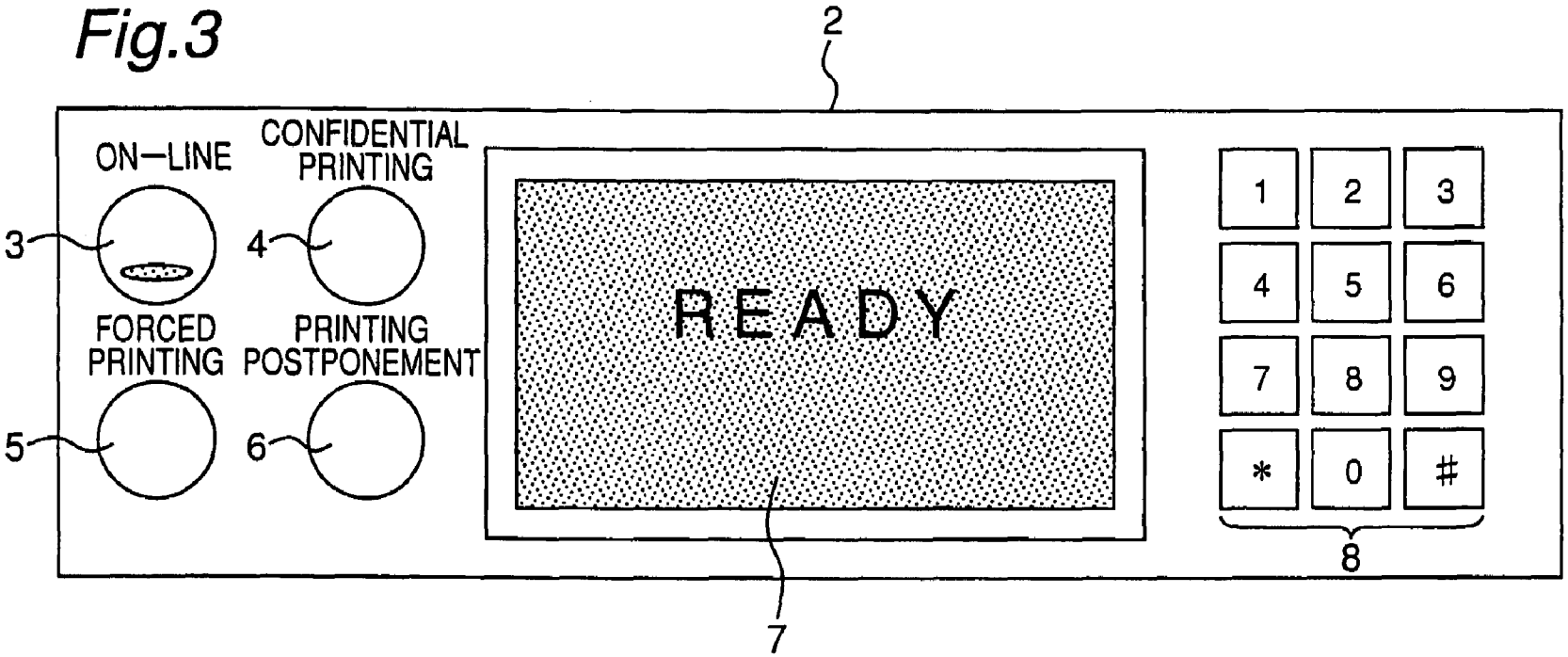
FIG. 3 is a view showing a console panel of the printer.

FIG. 3 is a view showing the console panel 2 of the printer 20. The console panel 2 is provided with a liquid crystal display 7 for displaying thereon a message such as "READY" as illustrated in FIG. 3 or a screen for setting various kinds of conditions. Furthermore, on the console panel 2 are disposed, as command input keys, a communication state switching key 3 for switching a communicable state with the PC 30 (i.e., ON-LINE) and an incommunicable state (i.e., OFF-LINE), a confidential printing key 4 for executing confidential printing, a forced printing key 5 for instructing forced printing as a finish remains uncompleted in the case where all the finishing process cannot be executed, and a printing postponing key 6 for instructing re-storing of confidential printing in such a manner as to perform printing after adjustment of conditions on the printer 20 side in the case where all the finishing process cannot be executed. Furthermore, on the console panel 2 is provided a numeric keypad 8 for inputting numerical values such as the number of sheets to be printed or a personal identification number.

As described above, the printer driver for controlling the printer 20 is installed on the PC 30, and thus, it is booted up, for example, at the request of printing from application software. In this booted state, the printer driver provides a setting screen 60 (see FIGS. 6, 7 and 8), on which various kinds of conditions relative to printing such as the number of sheets to be printed, the printing range and the size of the sheet can be set. Together with the printer driver, utility software (not illustrated) capable of acquiring various kinds of information on the printer 20 is installed on the PC 30. The utility software is booted up at the time of starting of the PC 30 or in response to a call from the printer driver. In the operated state, it is possible to acquire information on the printer 20 and its optional devices connected to the printer 20 such as the connected state of the optional devices or the presence of consumable items via the communications with the printer 20. The connected state of the optional devices or the presence of consumable items is detected through the optional I/F 26.

The utility software can convert the acquired information into a file format (e.g., a text format) which can be read by the printer driver, and then, can store it in the PC 30. FIG. 4 illustrates one example of the information which has been converted into the file format.

Figure 5:
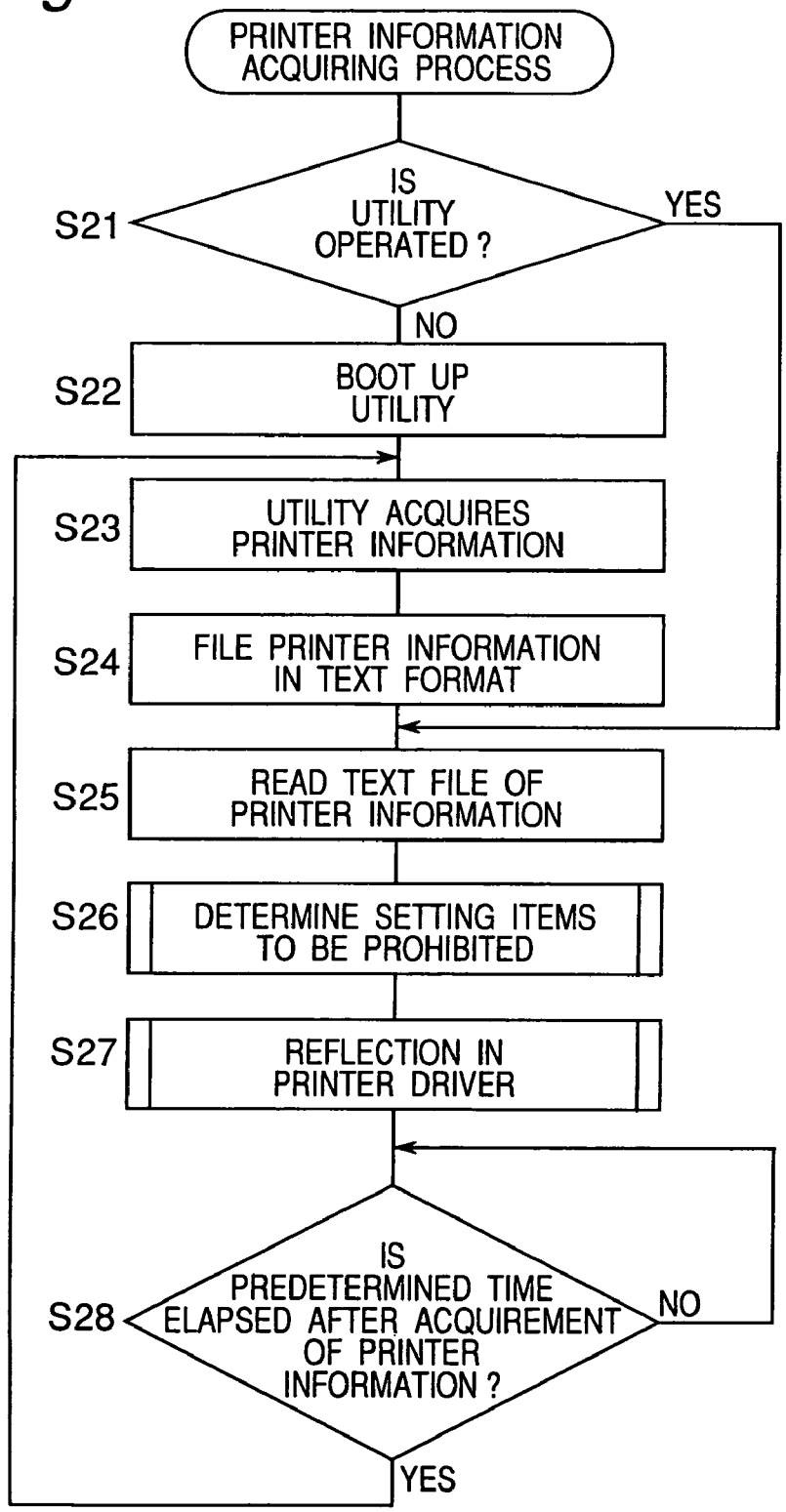
FIG. 5 is a flowchart illustrating printer information acquiring process.

In the present embodiment, during the booted state of the printer driver, the information on the printer 20 is acquired and stored at predetermined time intervals by the utility software and new information is reflected in the printer driver, so that an operator can accurately grasp the state of the printer 20. In relation to this, FIG. 5 is a flowchart illustrating printer information acquiring process. When the printer driver is booted up at the request of printing, it is first checked in step S21 as to whether or not the utility software is operated. If the result is affirmative, the routine jumps to step S25; otherwise, if the result is negative, the routine proceeds to step S22. In step S22, the utility software is booted up. Next, in step S23, various kinds of information on the printer 20 and the optional devices connected to the printer 20 are acquired by means of the utility software. Furthermore, in step S24, the acquired information is filed in a text format. In step S25, the text file stored in the PC 30 by the utility software is read.

Subsequently, in step S26, setting items to be prohibited on the setting screen of the printer driver are determined based on the acquired information on the printer. Examples of the setting items to be prohibited include "double-sided printing" in the state in which the double-sided printing unit 11 (see FIG. 1) is not connected to the printer 20, or "Staple" or "Punch" in the state in which the finisher 12 is not disposed. The process of determining the setting items to be prohibited will be described later in reference to FIG. 9. In step S27, the acquired information on the printer and the determination result in step S26 are reflected in the printer driver. In this case, the items determined in step S26 as the setting items to be prohibited are grayed out (or shaded) in such a manner as to be disabled from being selected. Otherwise, in order to disable the setting items to be prohibited from being selected, such items may be deleted from a menu of choices.

The printer information acquiring process is executed based on an operating program installed on the PC 30. In the present embodiment, the program is stored in a storage device such as a hard disk drive 30*c* (see FIG. 2) in the PC 30. Such a program can be installed on the storage device using a computer-readable floppy disk 30*a* (see FIG. 2) and a CD-ROM.

Figure 6:
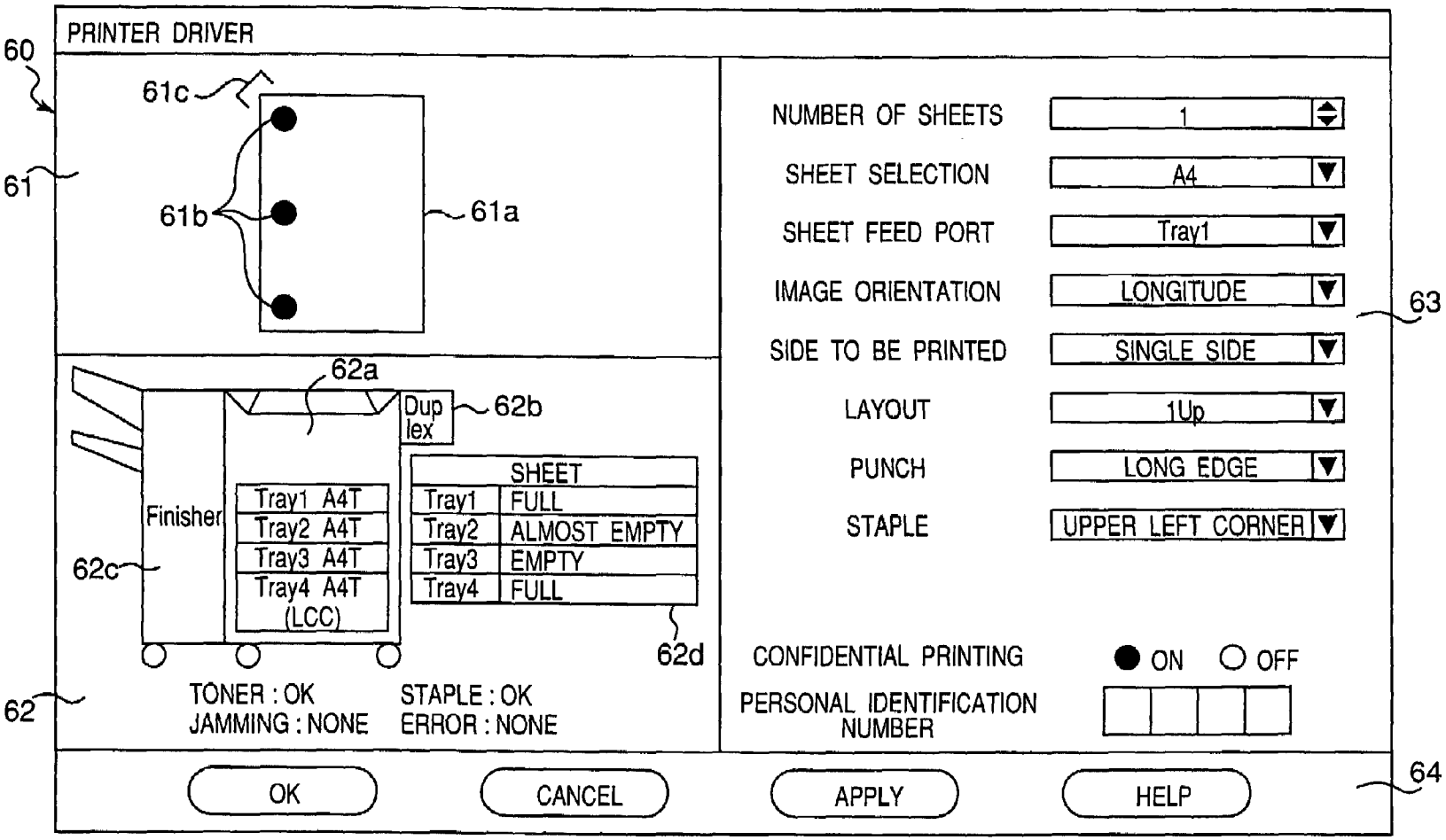
FIG. 6 illustrates an example of a setting screen of a printer driver, in which printer information and a result determined in step S26 of FIG. 5 are reflected.
Figure 7:
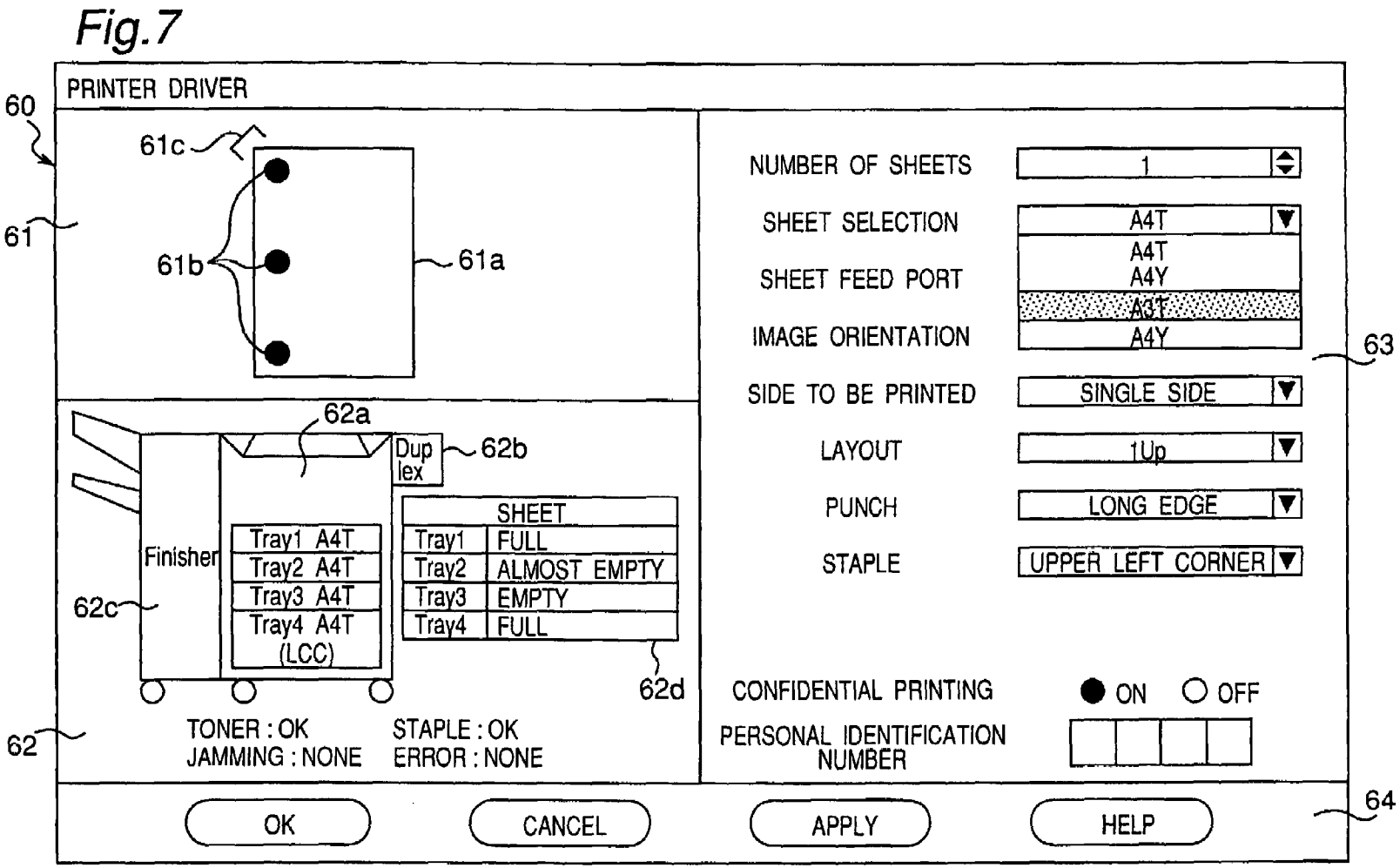
FIG. 7 illustrates another example of the setting screen of the printer driver, in which the printer information and the result determined in step S26 of FIG. 5 are reflected.

FIGS. 6 and 7 illustrate examples of the setting screen of the printer driver, in which the printer information and the result determined in step S26 of FIG. 5 are reflected. The setting screen 60 is constituted of an appearance display section 61 for displaying the final appearance at the time of outputting, a printer body information display section 62 for displaying the state of a printer body, a condition setting section 63 for setting various kinds of conditions, and an executing section 64 provided with various kinds of execution keys. On the printer body information display section 62 are schematically displayed the printer body and the optional devices connected to the printer body. In FIG. 6, there are displayed a double-sided printing unit 62*b* and a finisher 62*c* together with a printer body 62*a*. This display reveals that the double-sided printing unit 11 and the finisher 12 are connected to the printer 20. Moreover, on the printer body information display section 62 is displayed information on "Toner," "Jamming," "Staple" or "Error." That is, with respect to "Toner," there is displayed information as to whether or not developing toner remains enough to achieve the printing operation; with respect to "Jamming," there is displayed information as to whether or not paper jamming occurs in the printer 20; with respect to "Staple," there is displayed information as to whether or not staples remain in the finisher 12; and with respect to "Error," there is displayed information as to whether or not an error occurs in the printer 20 or its optional devices. FIG. 6 shows the display indicating that a sufficient quantity of toner remains, no paper jamming occurs, staples remain in the finisher 12 and no error occurs.

Additionally, on the printer body information display section 62 is displayed a table 62*d* showing the remaining number of sheets different in size or orientation, stacked in the first to fourth trays 9A to 9D in the printer 20. In FIG. 6, the table 62*d* shows that "Tray 3" corresponding to the third tray 9C is "Empty," and therefore, it is found that the sheets stacked in the third tray 9C in the printer 20 are used up. FIG. 7 illustrates the state in which the result determined in step S26 of FIG. 5 is reflected based on the sheet-out information. In FIG. 7, a box of the item "Sheet Selection" is opened in the condition setter 63. In this box, symbols "A4T," "A4Y," "A3T" and "A4" indicating the sizes and orientations of the sheets respectively corresponding to the first to fourth trays 9A to 9D in the printer 20 are arranged in order from top. Among these symbols, the symbol "A3T" is determined to be a setting item to be prohibited based on the sheet-out information on the third tray 9C, so that the symbol "A3T" is grayed out, i.e., cannot be selected. Consequently, the operator cannot select, on the printer driver, the symbol "A3T" indicating the sheet-out condition on the printer 20. Therefore, it is possible to avoid any change in finish or any discard of job data because the printer 20 and its optional devices cannot cope with the job data transmitted from the PC 30.

In the meantime, the final appearance of a printout is schematically displayed on the appearance display section 61 based on the set conditions in the condition setter section 63. As shown in FIG. 6, in the case where "Long Edge" and "Upper Left Corner" are respectively set in the items "Punch" and "Staple" in the condition setting section 63, punch holes 61*b* together with a sheet 61*a* are displayed over one long edge of the sheet 61*a* on the appearance display section 61, and further, a staple 61*c* is displayed at the upper left corner of the sheet 61*a*.

Figure 8:
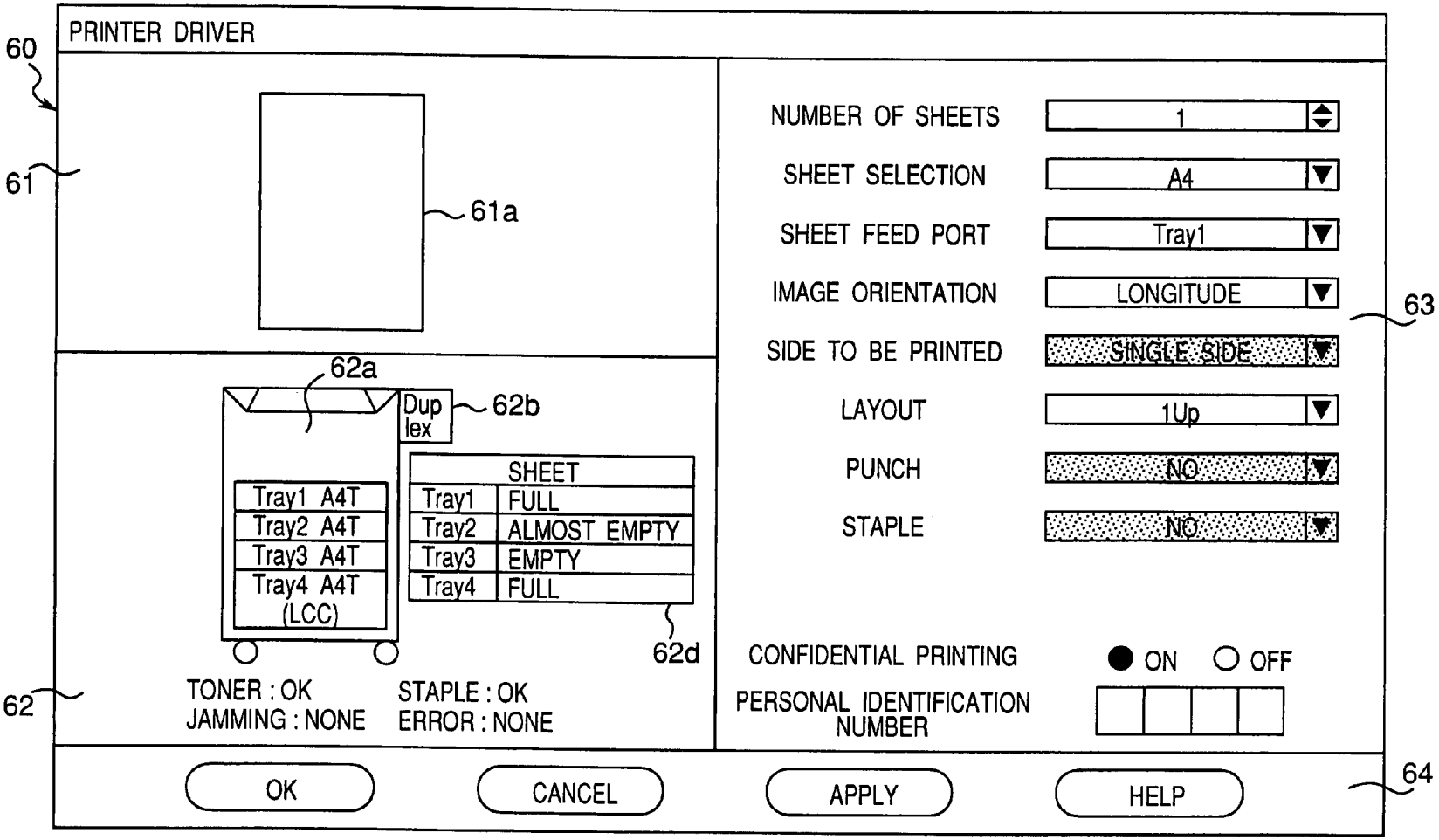
FIG. 8 illustrates a further example of the setting screen of the printer driver, in which the printer information and the result determined in step S26 of FIG. 5 are reflected.

Moreover, FIG. 8 illustrates a further example of the setting screen of the printer driver, in which the printer information and the result determined in step S26 of FIG. 5 are reflected. In this example, no optional device connected to the printer body 62*a* is displayed on the printer body information display section 62. Therefore, this display shows that neither the double-sided printing unit 11 nor the finisher 12 are connected to the printer 20. In this case, since no finisher 12 is connected, no information on "Staple" is displayed on the printer body information display section 62. The result determined in step S26 of FIG. 5 based on the above-described information on the optional devices is reflected in the condition setting section 63. Namely, the items "Printing Side," "Punch" and "Staple" are determined to be setting items to be prohibited based on the information that neither the double-sided printing unit 11 nor the finisher 12 are connected to the printer 20, so that these items are grayed out, and therefore, cannot be selected. In the example illustrated in FIG. 8, the item "Printing Side", "Punch" and "Staple" are grayed out as they are set in "Single-side", "No" and "No", respectively. Therefore, the operator cannot change such setting conditions. As a result, it is possible to avoid any change in finish or any discard of the job data because the printer 20 cannot cope with the job data transmitted from the PC 30.

As described above, according to the present embodiment, the information on the printer 20 and its optional devices connected to the printer 20 is acquired at predetermined time intervals, and then, the setting conditions in the printer driver are automatically updated based on the information, so that the operator can accurately grasp the states of the printer 20 and its optional devices. Furthermore, the operator can previously check as to whether or not a desired finish can be obtained. In the case where it is found that no desired finish can be obtained, it is possible to avoid any change in finish or any discard of the job data by, for example, varying the size of sheets stacked in each of the trays 9A to 9D or supplementing the sheets or the toner in advance. As a result, the job data which can be coped with by the printer 20 and its optional devices can be transmitted all the time, thereby efficiently achieving the printing operation.

Figure 9:
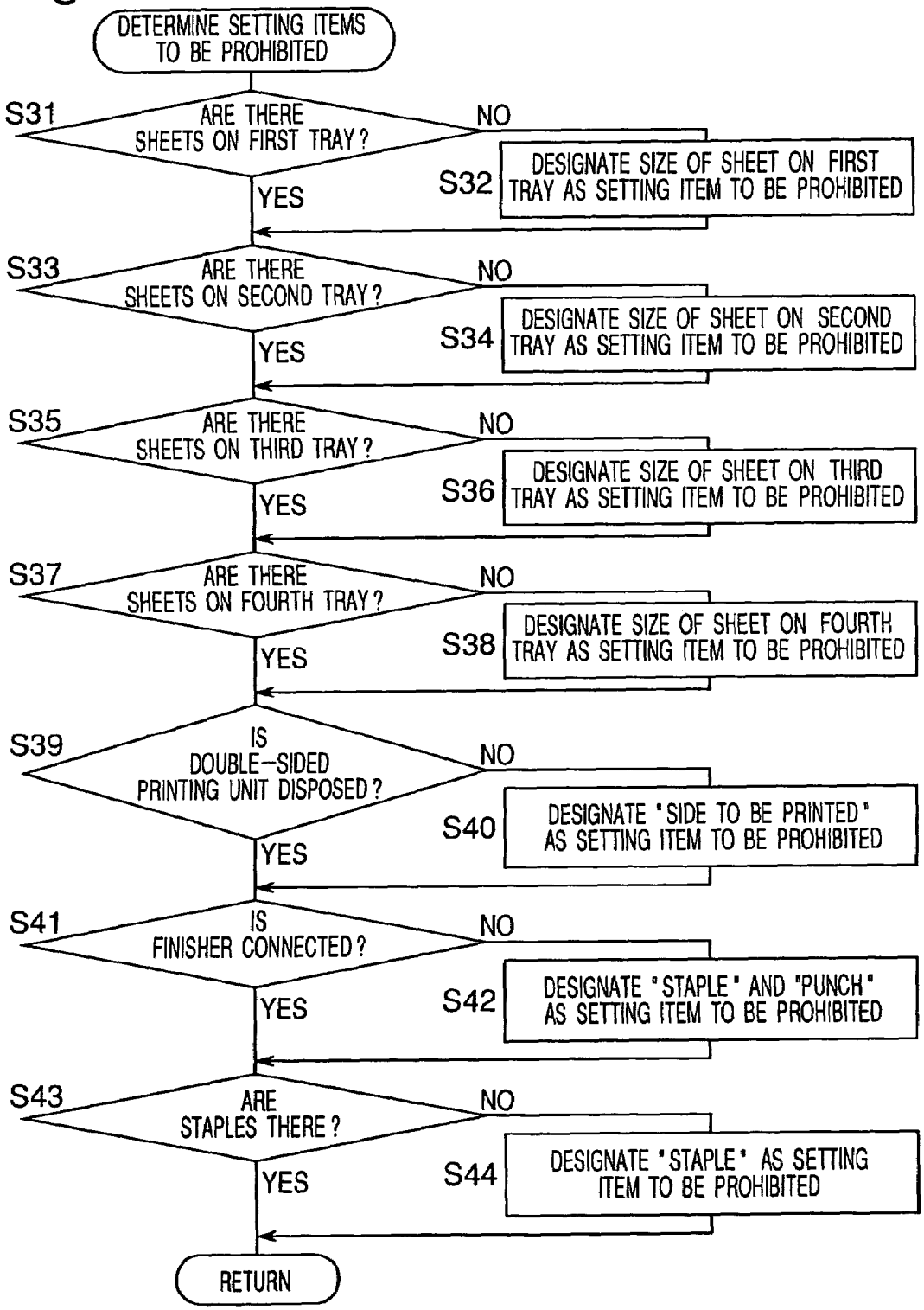
FIG. 9 is a flowchart illustrating the process of determining setting items to be prohibited (step S26 of FIG. 5)

FIG. 9 is a flowchart illustrating the process of determining the setting items to be prohibited (step S26 of FIG. 5). In the process of determining the setting items to be prohibited, it is first determined in step S31 as to whether or not there are sheets in the first tray 9A in the printer 20. If the result is affirmative, the routine proceeds directly to step S33; in contrast, if the result is negative, the sheet size of the first tray 9A in the item "Sheet Selection" is designated as the setting item to be prohibited in step S32, and then, the routine proceeds to step S33. In step S33, it is determined as to whether or not there are sheets in the second tray 9B in the printer 20. If the result is affirmative, the routine proceeds directly to step S35; in contrast, if the result is negative, the sheet size of the second tray 9B in the item "Sheet Selection" is designated as the setting item to be prohibited in step S34, and then, the routine proceeds to step S35. Subsequently, in step S35, it is determined as to whether or not there are sheets in the third tray 9C in the printer 20. If the result is affirmative, the routine proceeds directly to step S37; in contrast, if the result is negative, the sheet size of the third tray 9C in the item "Sheet Selection" is designated as the setting item to be prohibited in step S36, and then, the routine proceeds to step S37. Furthermore, in step S37, it is determined as to whether or not there are sheets in the fourth tray 9D in the printer 20. If the result is affirmative, the routine proceeds directly to step S39; in contrast, if the result is negative, the sheet size of the fourth tray 9D in the item "Sheet Selection" is designated as the setting item to be prohibited in step S38, and then, the routine proceeds to step S39.

In step S39, it is determined as to whether or not the double-sided printing unit 11 is disposed in the printer body. If the result is affirmative, the routine proceeds directly to step S41; in contrast, if the result is negative, the item "Printing Side" is designated as the setting item to be prohibited in step S40, and then, the routine proceeds to step S41. In this case, the item "Printing Side" is automatically set to "Single Side." Subsequently, it is determined in step S41 as to whether or not the finisher 12 is connected to the printer body If the result is affirmative, the routine proceeds directly to step S43; in contrast, if the result is negative, the items "Punch" and "Staple" are designated as the setting items to be prohibited in step S42, and then, the routine proceeds to step S43. In step S43, it is determined as to whether or not there are staples. If the result is affirmative, the routine is returned to the main routine illustrated in FIG. 5; in contrast, if the result is negative, the item "Staple" is designated as the setting item to be prohibited in step S44, and then, the routine is returned to the main routine illustrated in FIG. 5.

Figure 10:
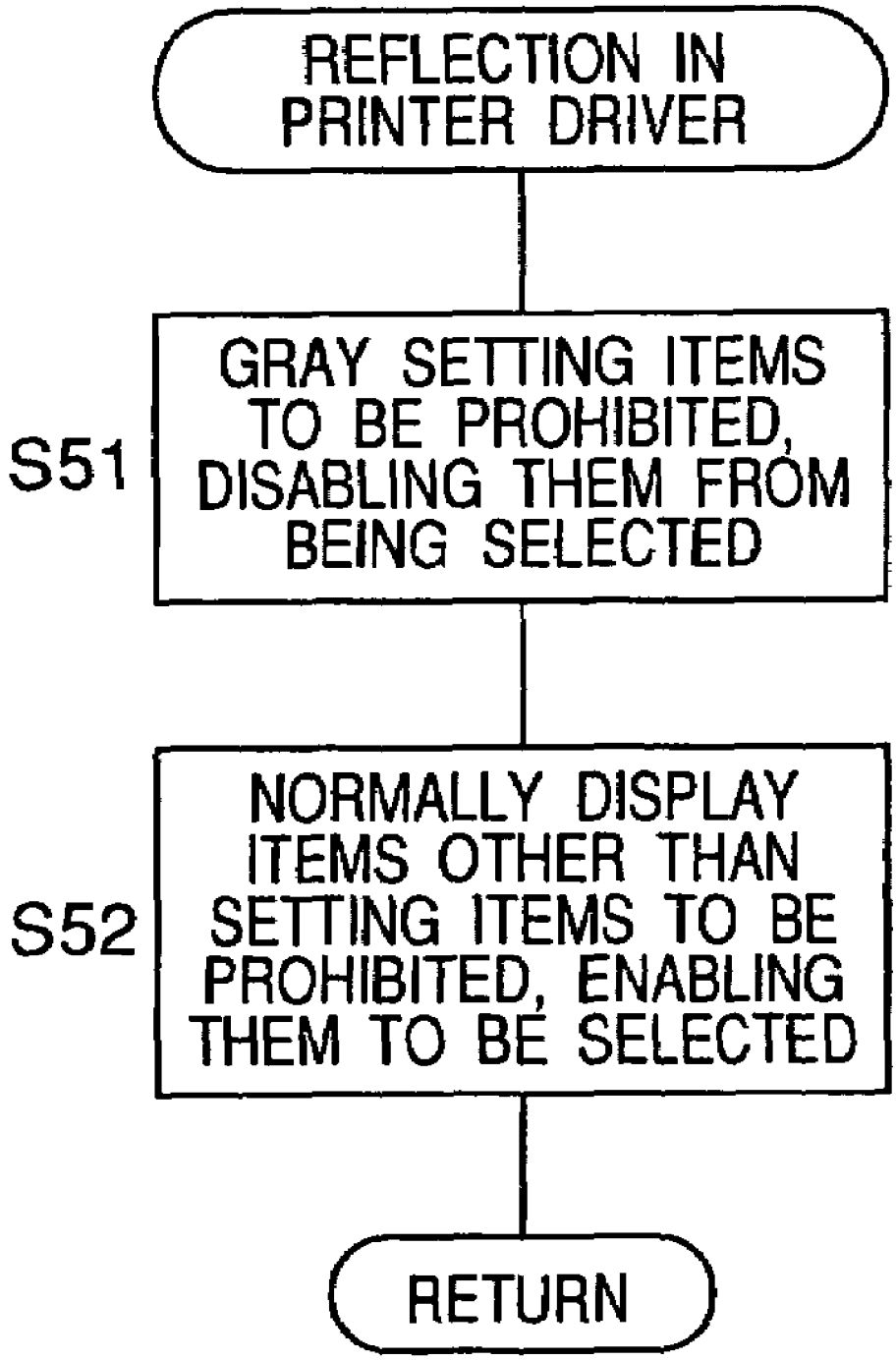
FIG. 10 is a flowchart illustrating the process of reflecting the printer information on a driver display (step S27 of FIG. 5).

Moreover, FIG. 10 is a flowchart illustrating the process of reflecting the printer information in the driver display (step S27 of FIG. 5). In this reflecting process, first in step S51, the items designated as the setting items to be prohibited are grayed out, and therefore, cannot be selected. Next, in step S52, the items not designated as the setting items to be prohibited are normally displayed, and therefore, can be selected. Upon completion of this process, the routine is returned to the main routine illustrated in FIG. 5.

Finally, it is obvious that the present invention is not limited to the embodiments described above, and various kinds of modifications and changes in designing may be possible without departing from the scope of the present invention. For example, in the above-described embodiment, although the utility software for acquiring the information on the printer 20 and its optional devices to be connected to the printer 20 is installed on the PC 30, the printer driver per se may acquire the information on the printer 20 and its optional devices.

What is claimed is:

1. A printer control apparatus having installed thereon printer driver software for controlling a printer connected to the printer control apparatus, said printer driver software operating to provide a user with a setting screen on which various user-selectable setting options for printing are displayed, and visually disabling at least one of the setting options from the setting screen based on information about the state of the printer acquired from the printer.

2. The printer control apparatus of claim 1, wherein, based on the information about the state of the printer, the printer driver software visually disables at least one of the setting options from the setting screen without user selection of any of the setting options.

3. The printer control apparatus of claim 1, wherein said at least one of the setting options is not displayed on the setting screen based on the information about the state of the printer.

4. The printer control apparatus of claim 3, wherein said at least one of the setting options is deleted from the setting screen based on the information about the state of the printer.

5. The printer control apparatus of claim 1, wherein said at least one of the setting options is displayed but is grayed out from the setting screen based on the information about the state of the printer.

6. The printer control apparatus of claim 1, wherein the information about the state of the printer acquired from the printer is stored in the printer control apparatus.

7. The printer control apparatus of claim 1, wherein the information about the state of the printer is intermittently acquired from the printer.

8. The printer control apparatus of claim 1, wherein the information about the state of the printer comprises at least one of the following items of information:

first information about a remaining amount of a consumable item loaded in the printer or an optional device connected to the printer;

second information about a size of the recording medium loaded in the printer; and third information as to whether or not the optional device is connected to the printer.

9. The printer control apparatus of claim 8, wherein the information about the state of the printer comprises the first information, and the consumable item comprises at least one of recording media, printing materials, and staples.

10. The printer control apparatus of claim 1, wherein the printer is connected to the printer control apparatus through a computer network.

11. A method carried out in a printer control apparatus for controlling a printer connected to the printer control apparatus, comprising the steps of:

(1) providing a user with a setting screen on which various user-selectable setting options for printing are displayed; and (2) visually disabling at least one of the setting options from the setting screen based on information about the state of the printer acquired from the printer.

12. The method of claim 11, wherein, in step (2), said at least one of the setting options is visually disabled from the setting screen without user selection of any of the setting options.

13. The method of claim 11, wherein, in step (2), said at least one of the setting options is not displayed on the setting screen.

14. The method of claim 13, wherein, in step (2), said at least one of the setting options is deleted from the setting screen.

15. The method of claim 11, wherein, in step (2), said at least one of the setting options is displayed but is grayed out from the setting screen.

16. The method of claim 11, wherein the information about the state of the printer acquired from the printer is stored in the printer control apparatus.

17. The method of claim 11, wherein, in step (3), the information about the state of the printer is intermittently acquired from the printer.

18. The method of claim 11, wherein the information about the state of the printer comprises at least one of the following items of information:

first information about a remaining amount of a consumable item loaded in the printer or an optional device connected to the printer;

second information about a size of the recording medium loaded in the printer; and third information as to whether or not the optional device is connected to the printer.

19. The method of claim 18, wherein the information about the state of the printer comprises the first information, and the consumable item comprises at least one of recording media, printing materials, and staples.

20. The method of claim 11, wherein the printer is connected to the printer control apparatus through a computer network.

21. A computer-readable medium containing instructions for causing a printer control apparatus to execute a method of controlling a printer from the printer control apparatus, comprising:

(1) providing a user with a setting screen on which various user-selectable setting options for printing are displayed; and (2) visually disabling at least one of the setting options from the setting screen based on information about the state of the printer acquired from the printer.

22. The computer-readable medium of claim 21, wherein, in step (2), said at least one of the setting options is visually disabled from the setting screen without user selection of any of the setting options.

23. The computer-readable medium of claim 21, wherein, in step (2), said at least one of the setting options is not displayed on the setting screen.

24. The computer-readable medium of claim 23, wherein, in step (2), said at least one of the setting options is deleted from the setting screen.

25. The computer-readable medium of claim 21, wherein, in step (2), said at least one of the setting options is displayed but is grayed out from the setting screen.

26. The computer-readable medium of claim 21, wherein the information about the state of the printer acquired from the printer is stored in the printer control apparatus.

27. The computer-readable medium of claim 21, wherein, in step (3), the information about the state of the printer is intermittently acquired from the printer.

28. The computer-readable medium of claim 21, wherein the information about the state of the printer comprises at least one of the following items of information:

first information about a remaining amount of a consumable item loaded in the printer or an optional device connected to the printer;

second information about a size of the recording medium loaded in the printer; and third information as to whether or not the optional device is connected to the printer.

29. The computer-readable medium of claim 28, wherein the information about the state of the printer comprises the first information and the consumable item comprises at least one of recording media, printing materials, and staples.

30. The computer-readable medium of claim 21, wherein the printer is connected to the printer control apparatus through a computer network.

31. A printer control apparatus having installed thereon printer driver software for controlling a printer connected to the printer control apparatus, said printer driver software operating to provide a user with a setting screen on which various user-selectable setting options for printing are displayed, and visually indicates disablement of at least one of the setting options from the setting screen based on information about the state of the printer acquired from the printer.

32. The printer control apparatus of claim 31, wherein, based on the information about the state of the printer, the printer driver software visually indicates disablement of at least one of the setting options from the setting screen without user selection of any of the setting options.

33. The printer control apparatus of claim 31, wherein said at least one of the setting options is displayed but is grayed out from the setting screen based on the information about the state of the printer.

34. The printer control apparatus of claim 31, wherein the information about the state of the printer acquired from the printer is stored in the printer control apparatus.

35. The printer control apparatus of claim 31, wherein the information about the state of the printer is intermittently acquired from the printer.

36. The printer control apparatus of claim 31, wherein the information about the state of the printer comprises at least one of the following items of information:

first information about a remaining amount of a consumable item loaded in the printer or an optional device connected to the printer, second information about a size of the recording medium loaded in the printer, and third information as to whether or not the optional device is connected to the printer.

37. The printer control apparatus of claim 36, wherein the information about the state of the printer comprises the first information, and the consumable item comprises at least one of recording media, printing materials, and staples.

38. The printer control apparatus of claim 31, wherein the printer is connected to the printer control apparatus through a computer network.

39. A method carried out in a printer control apparatus for controlling a printer connected to the printer control apparatus, the method comprising the steps of:

(1) providing a user with a setting screen on which various user-selectable setting options for printing are displayed; and (2) visually indicating disablement of at least one of the setting options from the setting screen based on information about the state of the printer acquired from the printer.

40. The method of claim 39, wherein, in step (2), the disablement of said at least one of the setting options from the setting screen is visually indicated without user selection of any of the setting options.

41. The method of claim 39, wherein, in step (2), said at least one of the setting options is displayed but is grayed out from the setting screen.

42. The method of claim 39, wherein the information about the state of the printer acquired from the printer is stored in the printer control apparatus.

43. The method of claim 39, wherein, in step (3), the information about the state of the printer is intermittently acquired from the printer.

44. The method of claim 39, wherein the information about the state of the printer comprises at least one of the following items of information:

first information about a remaining amount of a consumable item loaded in the printer or an optional device connected to the printer;

second information about a size of the recording medium loaded in the printer; and third information as to whether or not the optional device is connected to the printer.

45. The method of claim 44, wherein the information about the state of the printer comprises the first information, and the consumable item comprises at least one of recording media, printing materials, and staples.

46. The method of claim 39, wherein the printer is connected to the printer control apparatus through a computer network.

47. A computer-readable medium containing instructions for causing a printer control apparatus to execute a method of controlling a printer from the printer control apparatus, comprising:

(1) providing a user with a setting screen on which various user-selectable setting options for printing are displayed; and (2) visually indicating disablement of at least one of the setting options from the setting screen based on information about the state of the printer acquired from the printer.

48. The computer-readable medium of claim 47, wherein, in step (2), the disablement of at least one of the setting options from the setting screen is visually indicated without user selection of any of the setting options.

49. The computer-readable medium of claim 47, wherein, in step (2), said at least one of the setting options is displayed but is grayed out from the setting screen.

50. The computer-readable medium of claim 47, wherein the information about the state of the printer acquired from the printer is stored in the printer control apparatus.

51. The computer-readable medium of claim 47, wherein, in step (3), the information about the state of the printer is intermittently acquired from the printer.

52. The computer-readable medium of claim 47, wherein the information about the state of printer comprises at least one of the following items of information:

first information about a remaining amount of a consumable item loaded in the printer or an optional device connected to the printer, second information about a size of the recording medium loaded in the printer, and third information as to whether or not the optional device is connected to the printer.

53. The computer-readable medium of claim 52, wherein the information about the state of the printer comprises the first information, and the consumable item comprises at least one of recording media, printing materials, and staples.

54. The computer-readable medium of claim 47, wherein the printer is connected to the printer control apparatus through a computer network.

* * * * *